US009573706B2

(12) United States Patent
Veix

(10) Patent No.: US 9,573,706 B2
(45) Date of Patent: Feb. 21, 2017

(54) MACHINE FOR FILLING BAGS

(71) Applicants: KHS GMBH, Dortmund (DE); KHS USA, INC., Waukesha, WI (US)

(72) Inventor: Scott Veix, Bradenton, FL (US)

(73) Assignee: KHS GMBH, Juchostrasse, Dortmund (DE)

( * ) Notice: Subject to any disclaimer, the term of this patent is extended or adjusted under 35 U.S.C. 154(b) by 0 days.

(21) Appl. No.: 14/441,739

(22) PCT Filed: Sep. 19, 2013

(86) PCT No.: PCT/EP2013/002827

§ 371 (c)(1),
(2) Date: May 8, 2015

(87) PCT Pub. No.: WO2014/072009

PCT Pub. Date: May 15, 2014

(65) Prior Publication Data

US 2015/0284116 A1 Oct. 8, 2015

(30) Foreign Application Priority Data

Nov. 9, 2012 (DE) ..... 10 2012 110 800

(51) Int. Cl.

| | |
|---|---|
| ***B65B 5/04*** | (2006.01) |
| ***B65B 25/00*** | (2006.01) |
| ***B65B 39/00*** | (2006.01) |
| ***B65B 1/24*** | (2006.01) |
| ***B65B 39/02*** | (2006.01) |
| ***B65B 63/02*** | (2006.01) |

(52) U.S. Cl.

CPC ..... *B65B 5/045* (2013.01); *B65B 1/24* (2013.01); *B65B 25/00* (2013.01); *B65B 39/002* (2013.01); *B65B 39/02* (2013.01); *B65B 63/02* (2013.01)

(58) Field of Classification Search

CPC ..... B65B 1/20; B65B 1/24; B65B 39/02
USPC ..... 141/10, 73, 114, 166
See application file for complete search history.

(56) References Cited

U.S. PATENT DOCUMENTS

| | | | | |
|---|---|---|---|---|
| 2,358,001 A | | 9/1944 | Cross et al. | |
| 3,078,628 A | | 2/1963 | Ready | |
| 3,235,389 A | | 2/1966 | Hertwig et al. | |
| 3,842,569 A | * | 10/1974 | McClelland | B65B 25/04 53/167 |
| 4,242,854 A | | 1/1981 | Nissen | |

(Continued)

FOREIGN PATENT DOCUMENTS

| | | |
|---|---|---|
| DE | 19714245 | 10/1998 |
| GB | 1520267 | 8/1978 |
| WO | WO 99/54213 | 10/1999 |

OTHER PUBLICATIONS

PCT International Searching Authority: PCT International Search Report dated Nov. 18, 2013; entire document.

*Primary Examiner* — Timothy L Maust
(74) *Attorney, Agent, or Firm* — Allen Dyer Doppelt Milbrath & Gilchrist

(57) ABSTRACT

A machine for filling bags for example with meat, vegetables, pet food, beef sausages or similar products of any desired shape or irregular size, and a corresponding method for filling such bags uses a filling system for feeding the product. Means for compressing the product also form a path for directing the product into the open bag. Introduction means drive the product along the path into the open bag.

13 Claims, 5 Drawing Sheets

(56) References Cited

U.S. PATENT DOCUMENTS

| | | | | | |
|---|---|---|---|---|---|
| 5,046,304 | A * | 9/1991 | Alameda | B65B 43/34 | 100/229 A |
| 5,113,918 | A * | 5/1992 | McGregor | B65B 37/00 | 141/100 |
| 5,327,947 | A * | 7/1994 | McGregor | B65B 1/08 | 100/145 |
| 5,349,996 | A * | 9/1994 | McGregor | B65B 39/08 | 141/10 |
| 7,856,792 | B2 * | 12/2010 | Koga | B65B 1/06 | 141/139 |

* cited by examiner

MACHINE FOR FILLING BAGS

CROSS-REFERENCE TO RELATED APPLICATIONS

This application is the §371 National Stage Entry of International Patent Application PCT/EP2013/002827, filed on Sep. 13, 2013, which claims the benefit of German Patent Application DE 10 2012 110 800.5, filed on Nov. 9, 2012, the contents of which applications are herein incorporated by reference in their entirety.

FIELD OF THE INVENTION

The invention relates to a machine for filling bags with, for example, meat, vegetables, pet food, beef sausages or similar products of any desired shape or irregular size.

BACKGROUND OF THE INVENTION

At the present time flexible bags are known in the field for the filling of, for example, drinks, powder products etc. and are in use, as described in WO 2011/072194 A2. The products are filled into the bags by, for example, a nozzle array for this reason.

In the case of products with any desired shape or irregular size this filling method cannot be used because the bag opening space available for introducing the products into the bag is limited. Furthermore some of these products do not flow freely into the opening or do not fall fully into the bag. It is for this reason that bag filling machines often require products of any desired shape to be pre-treated and compressed before they are directed into the bag. This pretreating or compressing often makes use of complex devices which define secondary product preparation systems. At these secondary preparation systems the products concerned are weighed or counted, conveyed to the bagging machine and have to be compressed into a size range which fits in the bag opening. The products also have to be driven to ensure that they are all conveyed fully into the bag.

These secondary product preparation systems are frequently separate from the primary bag filling machine, costing time and space. This means that the products requiring pretreatment are compressed or compacted to the required size range that fits into the bag opening in a separate stage before the bags are filled with the product. In this respect the market uses a number of methods to handle complicated products like these.

The most prevalent method is manual loading of the bags. This requires a great amount of manual effort, and the potential for error when loading the product is high. The slow throughput rate and the high risk of contamination with food products are further disadvantages. Other methods are very complex and expensive and often involve many different stages or operations to make the product ready for filling.

SUMMARY OF THE INVENTION

It is therefore one object of the present invention to disclose a simple machine for filling products which can prepare products of any desired shape or irregular size and guide and fill them into bags. A corresponding method for filling bags is also required.

These and other tasks are accomplished by a machine for filling bags with, for example, meat, vegetables, pet food, beef sausages or similar products of any desired shape or irregular size according to the invention, which comprises a filling system for feeding the product, means for compressing the product and forming a path for directing the product into the open bag and introduction means for driving the product along the path into the open bag, e.g. a stand up pouch. For the purposes of this invention, a shell or can which is manufactured, for example, from plastic and will be covered with an aluminium or plastic foil or aluminium or plastic film is not regarded as a bag.

In the case of this inventive bag filling machine the processes of filling, compressing and introducing the product into the open bag are combined in an inline filling system. In this context, the filling system normally conveys the products to the compression means by way of conventional transport elements and/or gravity. After reaching the compression means the product is compressed. A force opens the upper end of the bag such that the compression means are at least partially transferred into the open bag. For this reason the compressing means are provided with at least one first drive which can be operated to transfer the means into the open bag.

A second drive which is connected with the compression means can be operated to compress the product. In order to form a path for feeding the product into the open bag, the means for compressing combines preferably a compression box and subsequent duckbill jaws in the path direction. The compression box and the duckbill jaws normally form a complete and virtually right-angled path from the top of the compression box, which lies opposite the filling system, to the bottom of the duckbill jaws which are transferred into the open bag. This path with the roughly rectangular cross-sectional form defines the uniform path for the product which starts at the outlet of the filling system and ends inside the open bag to guarantee the charging of all products into the bag. This is achieved by a single machine or machine station, and in a subsequent operation. In case of larger loads and faster filling rates, a packing machine or bagging machine according to the invention can be provided with more than one station so as to further increase the throughput.

In any event the inventive system for compressing and introducing products functions as a single-station multifunction system which accepts products from the bulk goods loading system or filling system, compresses them, effects a forced opening of the bag, dropping of the product and final introducing of the product into the open bag so as to guarantee that all of the product is loaded into the bag.

It is preferable if the duckbill jaws are actuated jointly by the second drive. A front and a rear duckbill jaw are provided in this context. Therefore the two duckbill jaws are actuated only by one drive, the second drive, simplifying the design and saving money.

The second drive actuates the two duckbill jaws between an open position and a closed position. The open position of the two duckbill jaws enables the product to leave the compression means for filling the open bag, and ensures that all of the product is released by the duckbill jaws (and of course by the compression box upstream) and introduced into the bag. The closed position of the two duckbill jaws corresponds to the compressing and moving of the product by the first drive into the bag.

Since the compression box and the two duckbill jaws downstream of it constitute a uniform path which has a roughly rectangular cross-sectional form, the path for directing the product into the open bag exhibits roughly the form of a parallelepiped. The introduction means comprise a corresponding ejector head which is mounted on an ejector bar. The ejector head is introduced into the path for directing the product, and firstly into the compression box. Thereafter the ejector head reaches the duckbill jaws so as to release all of the product from the compression means. This is achieved with the compression box in the closed position and the duckbill jaws in the open position.

As already mentioned, the inventive method for the filling of bags with products of any desired shape or irregular size combines the feeding, the compressing and the transferring as well as the ejecting of the product in successive steps in an arrangement. In this respect a simple structure of the unit is provided whereby parts and the need for a lot of operating effort, regular cleaning and maintenance is reduced. The product contact region of the inventive machine can be easily removed from the machine for cleaning and disinfection, especially in the case of food packing systems. All necessary operating parts such as sliding pieces, cylinders and motors remain on the machine to prevent being damaged by aggressive cleaning methods and chemicals.

The unique combination of product compression box, duckbill-in-bag contact point and introduction in an all-in-one configuration allows the product to be handled in a single arrangement instead of its being transferred between arrangements. This guarantees minimal product loss or product waste and faster loading into the bag because all the functions can overlap. The duckbill arrangement acts not only as the bag entry device but also as a product collection point which enables the initially loaded product to move forward to the end of the closed duckbill jaws to provide more volume for loading the product. It also prevents product from bowing or backing up at the end of the filling point when the duckbill jaws are in their open position. Standard methods such as horizontal sliding doors, for example, can be provided for compressing the product with the compression means. Manual preparation and manual loading of the products into the bags or complicated and expensive mechanical systems which tend to fail are dispensed with. This is achieved through a mechanically simple system that reduces product and packing waste and makes it easier to clean parts that are in direct contact with the product. This also reduces the amount of maintenance with fewer wearing parts.

DETAILED DESCRIPTION OF PREFERRED EMBODIMENTS

Figure 1:
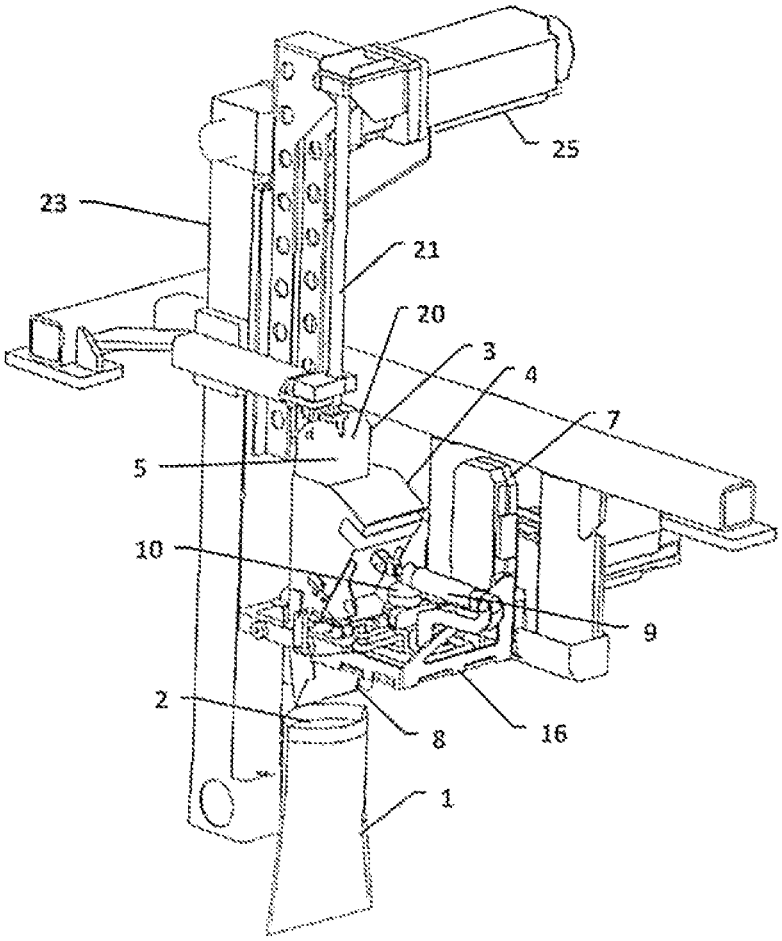
FIG. 1 is a perspective view of a machine for filling according to the invention.

FIG. 1 is a perspective overview of a machine for filling bags 1 according to the invention; a respective bag 1 is transferred to the machine with an opening 2 at the top for the product to be accepted in it. For this reason conventional transfer means are provided; they are not part of the invention and so are not disclosed in the drawings. The products that are to be filled exhibit any desired shapes or irregular sizes, such as for example meat, vegetables, pet food, beef sausages or similar products.

Figure 4A:
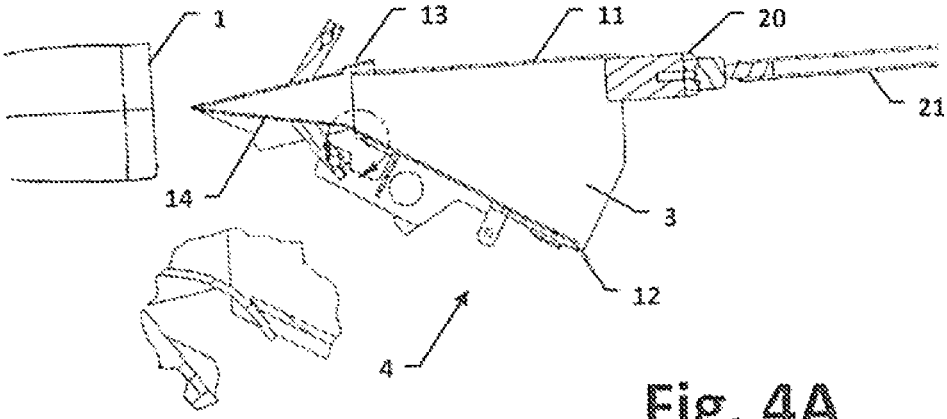
FIGS. 4A to 4E depict the main parts of the machine in a sectional side view which represents the successive steps of the inventive method for filling the bags.
Figure 4B:
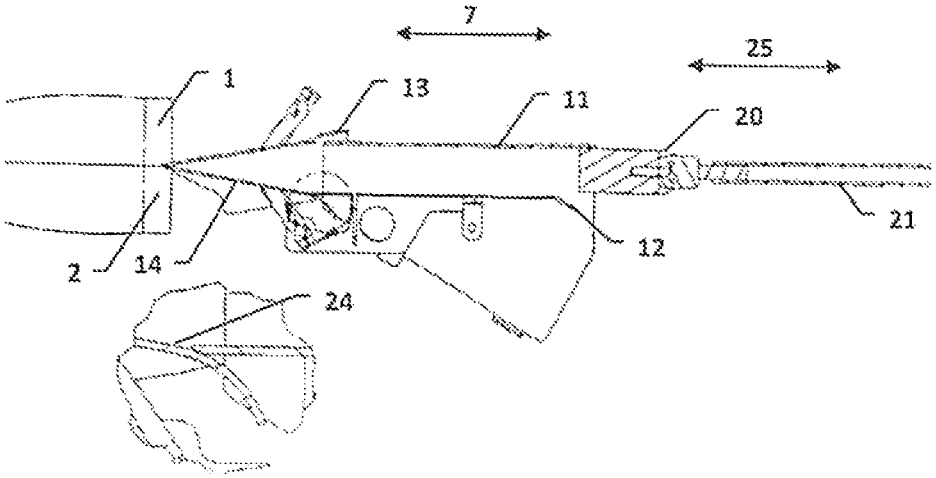
Figure 4C:
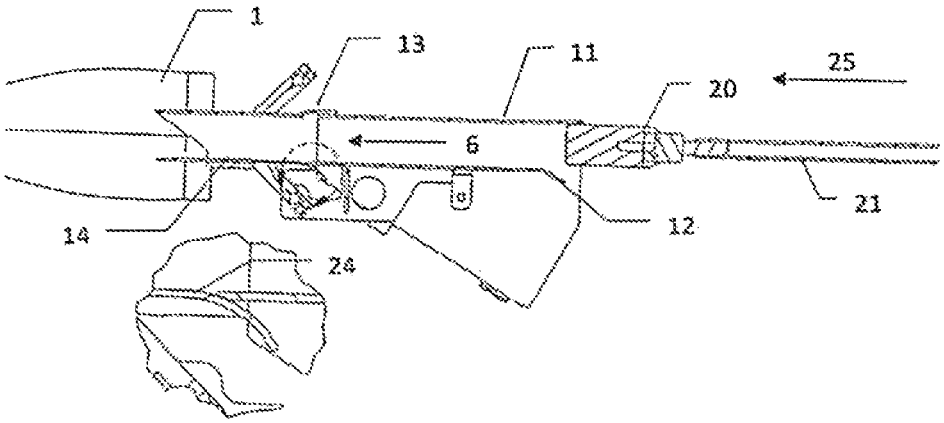

The products concerned are fed by a filling system 3 of conventional structure. Filling system 3 can comprise for example transport elements and/or feeder elements for the products which are to be introduced into bag 1. Because filling system 3 works in a conventional manner and does not form an important part of the invention, it is represented by an arrow 3 which is shown in FIGS. 1 and 4A only. This arrow 3 represents the introduction path of the products through gravity at the end of the transport to transfer the product into compression means 4. This means 4 for compressing the product not only prepares the product for the loading of bag 1 as a consequence of the compressing but also forms a path 6 for introducing the product into open bag 1. Path 6 is best seen in FIG. 4C which will be described later.

FIG. 1 also shows introduction means 5 which impel the product along path 6 into open bag 1. The unique combination of means 4 for compressing the product and of introduction means 5 allows the product to be handled in one machine instead of conveying it between separate arrangements. This guarantees minimal product loss or product waste. The loading process is faster and all functions can overlap other machine functions such as for example conveying or transferring open bag 1 into and out of the machine according to FIG. 1. This increases the throughput.

In detail, means 4 for compressing the product is provided with at least one first drive 7 which can be operated to transfer means 4 into open bag 1. First drive 7 is a vertical drive 7 which can be operated to lower and raise compression means 4 in relation to open bag 1. For this reason, first drive 7, as arranged in FIG. 1, is shown in FIG. 4B by an arrow.

Open bag 1 is in effect attached to the inventive machine in a loading station 8. After it has received the products that are to be filled, bag 1 is removed from loading station 8 to another machine or arrangement to be sealed and provided with an information code or the like. As already mentioned, the transport of open bag 1 into and out of loading station 8 can overlap with the compressing and directing of the product into the bag, as is described in detail below.

Loading station 8 with open bag 1 attached to it is located downstream at the end of path 6 which is defined essentially by means 4 for compressing the product. As shown in FIG. 1, filling system 3 is arranged upstream of path 6. Consequently the product which is to be introduced into bag 1 follows path 6 which is essentially oriented in the vertical direction. First drive 7 of compression means 4 operates in the vertical direction according to FIG. 1 which is oriented horizontally in FIG. 4A to 4E which are described below. A second drive 9, 10 of means 4 for compressing the product can be operated to compress the product.

Figure 2:
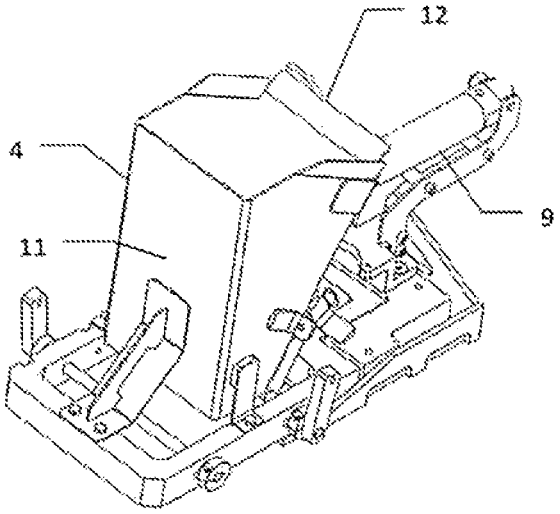
FIGS. 2 and 3 depict parts of the means for compressing the product.
Figure 3:
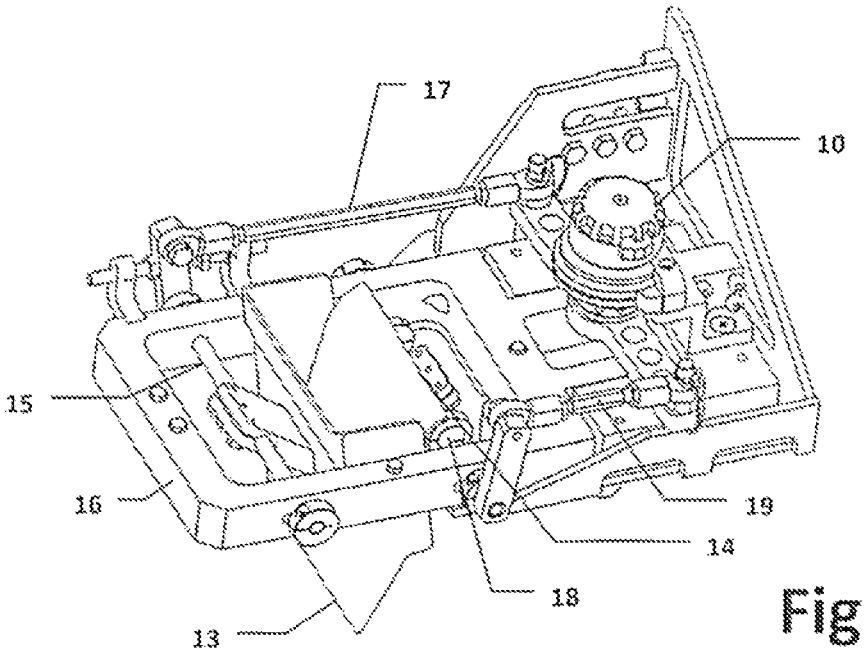

In this context, means 4 for compressing the product is essentially divided into two parts, a compression box 11, 12 which is shown in FIG. 2, and subsequent duckbill jaws 13, 14 downstream of it according to FIG. 3. Duckbill jaws 13, 14 are actuated together by second drive 9, 10. When means 4 for compressing the product is divided into two parts which are shown in FIGS. 2 and 3, then second driving means 9, 10 is also divided.

Described in detail, second drive 9, 10 comprises a first actuating element 9 which acts on a compression paddle 12 which is hinged to the downstream side of a three-sided container 11, which together form compression box 11, 12. As part of second drive 9, 10, second actuating element 10 acts on duckbill jaws 13, 14. To achieve this common motion, front duckbill jaw 13 is connected to a shaft 15 which is rotatably mounted within a frame 16. Second actuating element 10 is connected to shaft 15 by a pushrod 17. A further pushrod 19 connects a shaft 18 for the rotatable mounting of rear duckbill jaw 14 on frame 16.

When second actuating element 10 is driven counter-clockwise about its axes in FIG. 3, pushrod 17 forces front duckbill jaw 13 to rotate clockwise about shaft 15 such that front duckbill jaw 13 opens. The clockwise direction of second actuating element 10 forces shaft 18 of rear duckbill jaw 14 to rotate counter-clockwise such that rear duckbill jaw 14 is also opened. Second actuating element 10 is therefore able to operate the two duckbill jaws 13, 14 between an open position according to FIG. 4C to 4E and a closed position, as shown in FIGS. 4A and 4B.

Second drive 9, 10 also comprises first actuating element 9 which is connected to the compression paddle 12 that is hinged to container 11 downstream of path 6. In this respect, compression paddle 12 can be actuated between an open position to receive the product according to FIGS. 1 and 4A and a closed position shown in FIG. 4B to FIG. 4E. In this closed position, compression paddle 11 and/or compression box 11, 12 together with the two duckbill jaws 13, 14 define path 6 for directing the product into open bag 1. This path 6 corresponds to the closed position of compression box 11, 12 and the open position of the two duckbill jaws 13, 14.

Figure 4D:
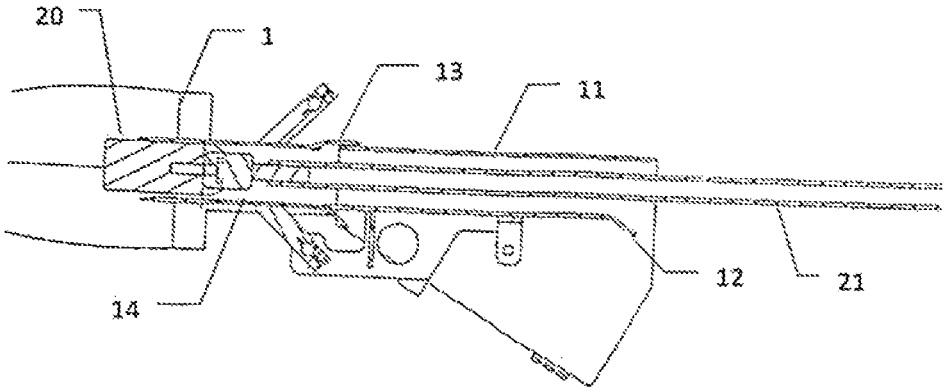
Figure 4E:
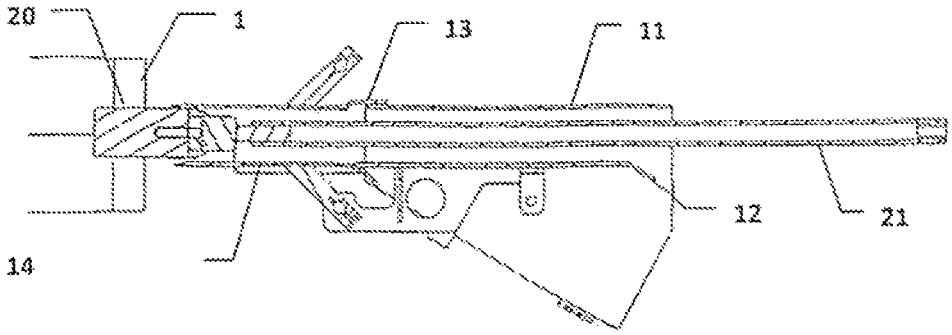

In this position, i.e. the closed position of compression box 11, 12 and the open position of the two duckbill jaws 13, 14 according to FIG. 4C to 4E, introduction means 5 is able to impel the product along path 6 into open bag 1. Introduction means 5 comprises an ejector head 20 and an ejector bar 21. Ejector head 20 is mounted on ejector bar 21. Ejector bar 21 and ejector head 20 move essentially in a vertical direction, i.e. in the same direction as path 6, so that ejector head 20 can follow path 6. For this reason ejector bar 21 is connected in a displaceable manner to a vertical sliding piece 23 of the machine and comprises an introducing drive 25.

Path 6 for directing the product into open bag 1 exhibits roughly the form of a parallelepiped, as can be seen for example from a comparison of FIGS. 1 and 4B. Compression box 11, 12 and duckbill jaws 13, 14 in effect form path 6 which exhibits a rectangular cross-sectional form. Ejector head 20 fits into the parallelepiped form of path 6 for directing the product from an inlet of compression means 4 to an outlet of compression means 4 as it transfers into open bag 1.

FIG. 1 shows ejector head 20 in a position near to the inlet of compression means 4, while FIG. 4D shows ejector head 20 as it reaches the outlet of compression means 4. In this position (cf. FIG. 4D) ejector head 20 guarantees that all of the product is released from compression box 11, 12 and from duckbill jaws 13, 14.

The machine operates as follows. FIG. 4A shows the machine and/or means 4 for compressing the product ready for the latter to be accepted. In FIG. 4A to 4E, compressing means 4, introduction means 5 and finally open bag 1 have been rotated 90° clockwise from the vertical direction as shown in FIG. 1 to a horizontal direction purely for the sake of clarity and to aid explanation.

Compressing begins as soon as the product that is to be filled into open bag 1 is filled into compressing means 4 by filling system 3 which is indicated in FIG. 4A by a corresponding arrow. The entire product is first fed by filling system 3 and compressed. This process of compressing is shown in FIG. 4B.

In the filling condition according to FIG. 4A and in the compressing condition which is depicted in FIG. 4B, the two duckbill jaws 13, 14 are in their respective closed positions to ensure that the product that is to be fed and then compressed does not escape from compressing means 4. Compressing begins when compression paddle 12 is closed according to FIG. 2. Because three-sided container 11 exhibits a rectangular form, the compression position of compression paddle 12 according to FIG. 4B corresponds to a rectangular region which is filled by the product to be compressed.

Rear duckbill jaw 14 and compression paddle 12 exhibit a single curved contact point 24 which prevents the product being wedged in or jammed in during the compressing or the opening of duckbill jaws 13, 14. At the same time, first drive 7 begins to move compression means 4 into open bag 1. In order to move compression means 4 downwards into open bag 1, the corresponding first drive 7 is operated accordingly. As soon as duckbill jaws 13, 14 have reached open bag 1, the two duckbill jaws 13, 14 are opened by second drive 9, 10 and/or by actuating element 10 as shown in FIG. 3.

After the opening of the two duckbill jaws 13, 14 into the open position as shown in FIG. 4C, path 6 for directing the product into open bag 1 is defined and completed. This path 6 corresponds to the open position of the two duckbill jaws 13, 14 and the closed position of compression box 11, 12. At this stage with open duckbill jaws 13, 14 and closed compression paddle 12, ejector head 20 is lowered by ejector bar 21 so as to release all of the product from compression box 11,12 and from duckbill jaws 13, 14. This ensures that all of the product is directed into bag 1 by drive 25 which operates ejector head 20 accordingly.

Once ejector head 20 has been fully lowered to the outlet position of path 6, as previously described and as shown in FIG. 4D, compression box 11, 12 and duckbill jaws 13, 14 are retracted by first drive 7. During the retraction of compression box 11, 12 and of duckbill jaws 13, 14, ejector head 20 remains at the previous end of path 6 so as to keep the product in the bag and to ensure that no product is left behind inside duckbill jaws 13, 14 when they close again (cf. FIG. 4E).

Once the upper end of bag 1 has been released as shown in FIG. 4E, duckbill jaws 13, 14, compression box 11, 12 and ejector head 20 all fully retract and get into position in readiness to receive the next load of the product, while a new empty open bag 1 moves into loading station 8 beneath duckbill jaws 13, 14.

The invention claimed is:

1. A machine for filling bags with product, the machine comprising:

a filling system for feeding the product;

means for compressing the product and for forming a path to direct the product into the open bag; and introduction means which impel the product along the path into the open bag;

wherein the means for compressing combines a compression box and subsequent duckbill jaws in the direction of the path, the duckbill jaws operable between an open position which allows the product to leave the compression means to fill the open bag, and a closed position which prevents the product from leaving the means for compressing.

2. The machine of claim 1 wherein the means for compressing the product is provided with at least one first drive which transfers the means into the open bag, and a second drive for compressing the product.

3. The machine of claim 2 wherein the duckbill jaws are jointly operated by the second drive.

4. The machine of claim 3 wherein a front and a rear duckbill jaw are provided.

5. The machine of claim 4 wherein the two duckbill jaws are actuated by the second drive between the open position and the closed position during the compressing and moving of the product by the first drive into the open bag.

6. The machine of claim 3 wherein the compression box acts like a mouth having a 3-sided container and a compression paddle which is hinged to the downstream side of the container.

7. The machine of claim 6 wherein the compression paddle can be actuated between an open position to accept the product from the filling system and a closed position which defines the path for directing the product into the open bag.

8. The machine of claim 1 wherein the path for directing the product into the open bag roughly exhibits the form of a parallelepiped.

9. The machine of claim 1 wherein the introduction means comprise an ejector head mounted on an ejector bar.

10. The machine of claim 9 wherein the ejector head is introduced—first into the compression box and then into the duckbill jaws—into the path for directing the product so as to release all of the product from the compression means in the closed position of the compression box and the open position of the duckbill jaws.

11. A method for filling bags with product, the method comprising the following steps:

feeding the product by a filling system;

in a compression box, compressing the product and forming a path to direct the product into the open bag, a terminal end of the path being closed;

driving the compression box and product toward the open bag such that the terminal end extends thereinto;

opening the terminal end of the path to release the compressed product; and driving the product along the path into the open bag.

12. The method of claim 11 wherein the feeding, compressing and releasing as well as the driving of the product is effected in successive steps within one arrangement.

13. A machine for filling bags with product, the machine comprising:

a filling system for feeding the product;

means for compressing the product and for forming a path to direct the product into the open bag; and introduction means which impel the product along the path into the open bag;

wherein the means for compressing the product is provided with at least one first drive which transfers the means into the open bag, and a second drive for compressing the product;

wherein the means for compressing combines a compression box and subsequent duckbill jaws in the direction of the path;

wherein the duckbill jaws are jointly operated by a drive for compressing the product;

wherein the compression box acts like a mouth having a 3-sided container and a compression paddle which is hinged to the downstream side of the container; and wherein the compression paddle can be actuated between an open position to accept the product from the filling system and a closed position which defines the path for directing the product into the open bag.

* * * * *